US007653542B2

(12) United States Patent
Schultz et al.

(10) Patent No.: US 7,653,542 B2
(45) Date of Patent: Jan. 26, 2010

(54) METHOD AND SYSTEM FOR PROVIDING SYNTHESIZED SPEECH

(75) Inventors: Paul T. Schultz, Colorado Springs, CO (US); Robert A. Sartini, Colorado Springs, CO (US)

(73) Assignee: Verizon Business Global LLC, Basking Ridge, NJ (US)

( * ) Notice: Subject to any disclaimer, the term of this patent is extended or adjusted under 35 U.S.C. 154(b) by 919 days.

(21) Appl. No.: 10/854,594

(22) Filed: May 26, 2004

(65) Prior Publication Data

US 2005/0267756 A1 Dec. 1, 2005

(51) Int. Cl.
*G10L 13/00* (2006.01)

(52) U.S. Cl. ..... 704/258; 704/260; 704/270.1

(58) Field of Classification Search ..... 704/260, 704/258, 270, 261, 266, 267, 270.1
See application file for complete search history.

(56) References Cited

U.S. PATENT DOCUMENTS 7,043,432 B2 * 5/2006 Bakis et al. ..... 704/260

OTHER PUBLICATIONS

Kaliski, "The MD2 Message-Digest Algorithm", Internet Engineering Task Force, Request for Comment 1319, Apr. 1992.

Rivest, "The MD4 Message-Digest Algorithm", Internet Engineering Task Force, Request for Comment 1320, Apr. 1992.

Rivest, "The MD5 Message-Digest Algorithm", Internet Engineering Task Force, Request for Comment 1321, Apr. 1992.

* cited by examiner

*Primary Examiner*—Huyen X. Vo

(57) ABSTRACT

An approach providing the efficient use of speech synthesis in rendering text content as audio in a communications network. The communications network can include a telephony network and a data network in support of, for example, Voice over Internet Protocol (VoIP) services. A speech synthesis system receives a text string from either a telephony network, or a data network. The speech synthesis system determines whether a rendered audio file of the text string is stored in a database and to render the text string to output the rendered audio file, if the rendered audio is determined not to exist. The rendered audio file is stored in the database for re-use according to a hash value generated by the speech synthesis system based on the text string.

21 Claims, 5 Drawing Sheets

METHOD AND SYSTEM FOR PROVIDING SYNTHESIZED SPEECH

FIELD OF THE INVENTION

The present invention relates to communications systems, and more particularly, to text-to-speech services.

BACKGROUND OF THE INVENTION

Text-to-speech (TTS) systems have wide applicability in telecommunications systems. These systems employ TTS engines to provide conversion of text files (e.g., voice response scripts and prompts, e-mail messages, etc.) to audio or spoken messages. That is, such TTS systems render text-based information using synthesized speech, typically invoking a TTS engine each time an audio rendering of text is required. It is recognized that sophisticated TTS capability is an expensive system resource in terms of resource utilization and development; further, if a telecommunication service provider employs TTS technology developed by a third party, the cost of licensing the technology can be high. Conventionally, systems that render text over audio interfaces do not perform any analysis of the text to ensure efficient synthesized speech generation, utilization, and management. Accordingly, efficient use of such costly resources would entail a reduction in the cost of such systems, resulting in greater profitability for the telecommunication service provider.

Moreover, it is recognized that the speech synthesis services of conventional TTS systems, in part because of the expense, are aimed at a narrow set of users, thus making availability very limited. Traditional deployment of TTS systems require specialized, proprietary implementations to particular subscribers, which typically are large telecommunication service providers. It is impractical for small entities to incur the cost of a TTS system or even a full license. Thus, such users have to settle for less advanced TTS technologies or foregoing the benefits of such technologies altogether.

Therefore, there is a need for a TTS system that operates with greater efficiency in terms of invocation of the TTS engine, thereby reducing operational cost. In addition, there is a need for a mechanism to enhance availability of TTS services to a diversity of users.

SUMMARY OF THE INVENTION

These and other needs are addressed by the present invention, in which an approach for providing Text-To-Speech (TTS) conversion permits rendered audio content to be re-used. A TTS engine generates a unique identifier, which in an exemplary embodiment, is a hash value in response to a text message (e.g., text string) sent from a requesting application. A database is searched to determine whether the text message has a corresponding audio file that has been previously rendered. The hash value is used as a file name of the rendered audio file. If the database does store the rendered audio file with the hash value, then the file is retrieved and transmitted to the requesting application. However, if the rendered audio file does not exist, then the text string is rendered in real-time and stored. This arrangement advantageously permits re-use of audio renderings, thereby minimizing the use of the TTS engine. Also, the TTS engine can be made widely available as part of, for example, a web-based service.

According to one aspect of the present invention, a method for providing speech synthesis is disclosed. The method includes receiving a text string; and determining whether a rendered audio file of the text string exists. Also, the method includes, if the rendered audio file does not exist, creating an audio file rendering of the text string. The audio file is stored for retrieval upon subsequent receipt of the text string.

According to another aspect of the present invention, a system for providing speech synthesis is disclosed. The system includes a communication interface configured to receive a text string; and a processor configured to determine whether a rendered audio file of the text string is stored in a database. The system also includes speech synthesis logic configured to render the text string to output the rendered audio file if the rendered audio is determined not to exist. The rendered audio file is stored in the database for retrieval upon subsequent receipt of the text string.

According to another aspect of the present invention, a computer-readable medium carrying one or more sequences of one or more instructions for providing speech synthesis is disclosed. The one or more sequences of one or more instructions including instructions which, when executed by one or more processors, cause the one or more processors to perform the steps of receiving a text string; determining whether a rendered audio file of the text string exists; and if the rendered audio file does not exist, creating an audio file rendering of the text string. The audio file is stored for retrieval upon subsequent receipt of the text string.

According to yet another aspect of the present invention, a system for providing speech synthesis in a communications network including a telephony network and a data network is disclosed. The system includes a speech synthesis node configured to receive a text string from one of the telephony network and the data network. The speech synthesis node is further configured to determine whether a rendered audio file of the text string is stored in a database and to render the text string to output the rendered audio file if the rendered audio is determined not to exist. The rendered audio file is stored in the database for re-use according to a hash value generated by the speech synthesis node based on the text string.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various obvious respects, all without departing from the spirit and scope of the present invention. Accordingly, the drawing and description are to be regarded as illustrative in nature, and not as restrictive.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF THE PREFERRED EMBODIMENT

A system, method, and software for providing speech synthesis are described. In the following description, for the purposes of explanation, numerous specific details are set forth in order to provide a thorough understanding of the present invention. It is apparent, however, to one skilled in the art that the present invention may be practiced without these specific details or with an equivalent arrangement. In other instances, well-known structures and devices are shown in block diagram form in order to avoid unnecessarily obscuring the present invention.

Figure 1:
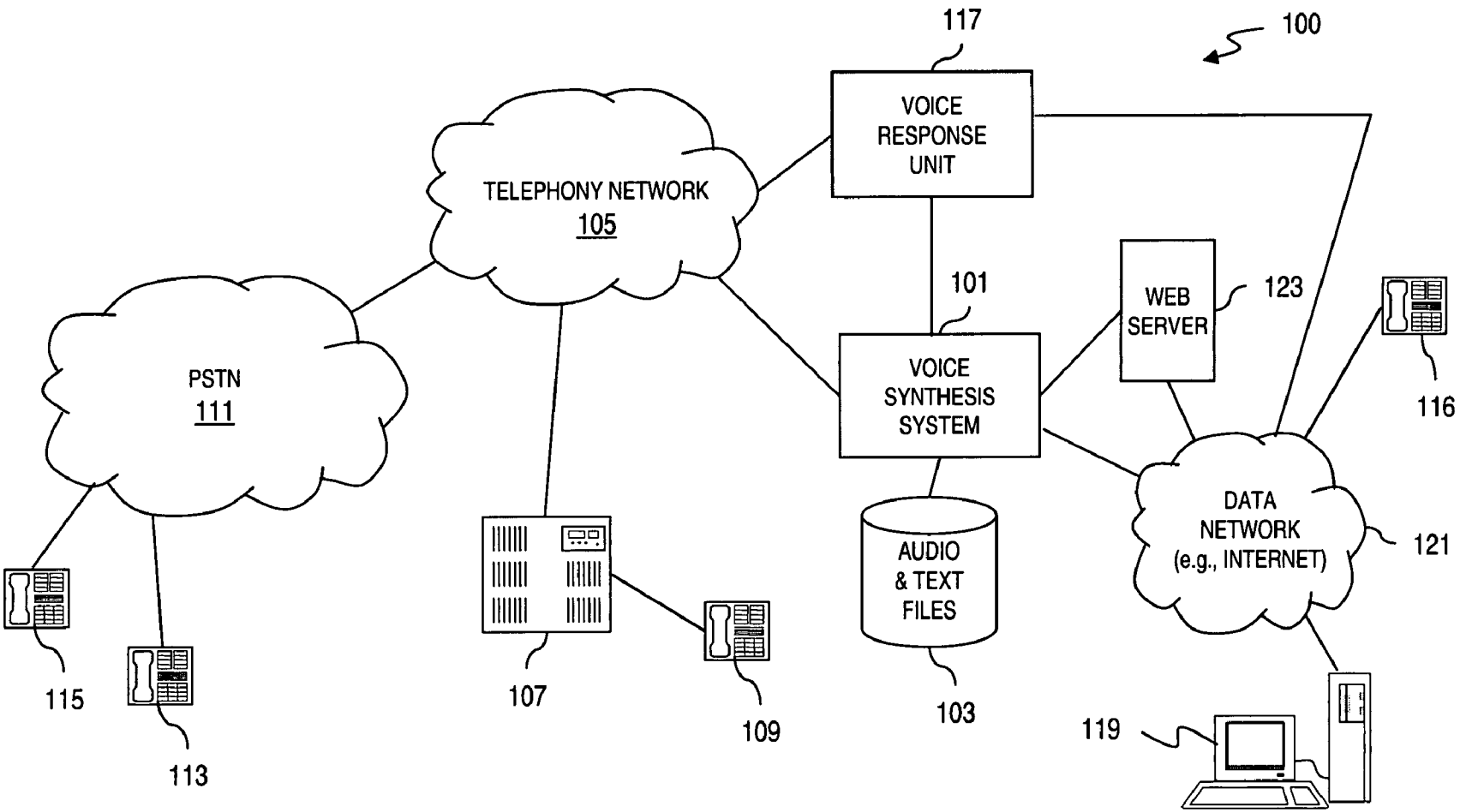
FIG. 1 is a diagram of a communication system providing text-to-speech services, according to an embodiment of the present invention.

FIG. 1 is a diagram of a communication system providing text-to-speech services, according to an embodiment of the present invention. Text-to-Speech (TTS) is a capability that renders textual information as natural sounding speech. As noted, TTS capability has tremendous applicability to communication services, for example, for rendering text-based non-deterministic and high volume content. Rendering web-based textual traffic conditions over a telephone station is an example of text-based non-deterministic content. Another example of audio rendering of non-deterministic text is a telephone-based e-mail reader, whereby TTS is required to render the Sender, Subject, and message contents to the caller.

As shown, a communication system 100 includes a voice synthesis system (or node) 101, which offers text-to-speech services. The voice synthesis system 101 employs a Text-to-Speech (TTS) engine (shown in FIG. 3) to render textual information as audio files, which are maintained as a catalog of rendered audio files within a database 103. The database 103 also stores text files associated with the rendered audio files; the text files contain the textual information. The system 101 advantageously provides availability of easily referenced text representation of the original text message. The system 100 facilitates the sending of time sensitive messages to text devices (e.g. PC Email, handheld computers, Personal Digital Assistants (PDAs) and pagers) as well as telephones. This capability has applicability to many applications, such as an emergency notification service.

The text-to-speech service, in an exemplary embodiment, can be supplied as part of a voice portal service. In the context of a voice portal service, the voice synthesis system 101 can render textual content to callers reachable by telephony network 105. These callers can originate calls from a behind a Private Branch Exchange (PBX) switch 107 using station 109, or from a Public Switched Telephone Network (PSTN) 111 via stations 113, 115. The system 100 also supports Voice over Internet Protocol (VoIP) communications, wherein a VoIP station 116 communicates with the data network 121 through a telephony gateway (not shown); the telephony gateway can have connectivity to both the telephony network 105 and the PSTN 111.

By way of example, an enterprise, such as a large business or organization, employs a PBX utilizing the functions of a voice response unit 117 resident, in which the enterprise users (e.g., station 109) can receive rendered audio from the voice synthesis system 101. When it is anticipated that non pre-recorded information will be required to be played more than once, the voice synthesis system 101 ensures that an audio representation is created, identified, and made available for subsequent renderings. This approach advantageously reduces the cost to provide these types of services by increasing the efficiency of rendering synthesized speech.

The voice synthesis system 101 (in conjunction with the voice response unit 117) can support high volume content, such as that found in an Address Capture Voice Portal service, whereby information such as "City and Street Name" are rendered back to the caller for confirmation. Table 1, below, provides an exemplary dialog:

TABLE 1

| ENTITY | MESSAGE |
|---|---|
| System | "Please say your Zip Code. If you don't know it, say your city and state." |
| Caller | 80816 |
| System | "That's the Zip Code for: <TTS> Florissant, Colorado </TTS>, is that right?" |
| Caller | Yes |
| System | "Okay, now say your street address including number." |
| Caller | 247 Pinewood Road |
| System | "I heard: <TTS> 247 Pinewood Road </TTS>, is that right?" |
| Caller | Yes |

Furthermore, the voice synthesis system 101 can supply text-to-speech services to data applications on a host 119. The host 119, for example, launches a web application that requires audio rendering of a text string. The text string is transmitted across the data network 121, such as the global Internet, to a web server 123, which communicates with the voice synthesis system 101 for processing of the text string. This process is more fully described below with respect to FIG. 2. Although the data network 121 is shown as the Internet, it is contemplated that the data network 119 can alternatively be a private data network (e.g., intranet, Virtual Private Network (VPN), etc.) utilizing various data networking technologies (e.g., Asynchronous Transfer Mode (ATM)).

Figure 2:
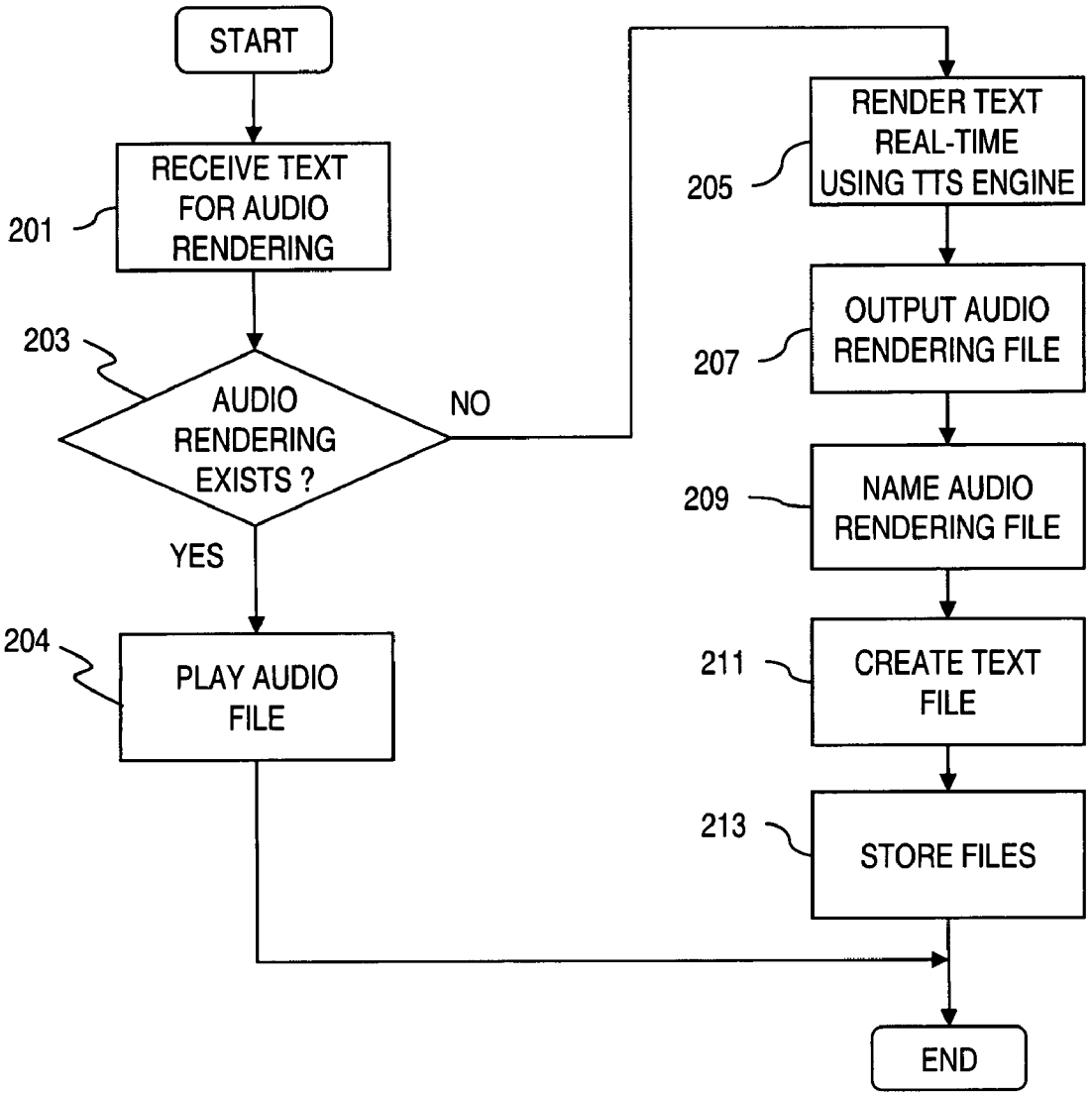
FIG. 2 is a flowchart of a process for rendering dynamic textual information, according to an embodiment of the present invention.

FIG. 2 is a flowchart of a process for rendering dynamic textual information, according to an embodiment of the present invention. When text for audio rendering is received by the voice synthesis system 101, as in step 201, the text is first analyzed and identified to determine whether an audio rendering of the text already exists (step 203). If the audio file exists, then the audio file is played, per step 204.

According to one embodiment of the present invention, this text analysis can be accomplished as follows. A TTS Generation, Utilization, and Management (TGUM) process calculates a hash representation of the message (i.e., text string). This hash process can be any standard message hashing algorithm, such as MD2, MD4, MD5, and Secure Hash Algorithm (SHA-1). MD2, MD4 and MD5 are message-digest algorithms and are more fully described in Internet Engineering Task Force (IETF) Request for Comments (RFCs) 1319-1321, which are incorporated herein by reference in their entireties. The structures of these algorithms, MD2, MD4 and MD5, are similar; however, MD2 is optimized for 8-bit machines, while MD4 and MD5 are tailored for 32-bit machines.

The system 101 attempts to use the audio file by locating the file within the database 103 specified by the hash value (i.e., hash index). If the audio file is not found, the application needs to utilize the true (real-time) TTS engine to render the message, as in step 205. Next, a rendered audio file is output, per step 207. In step 209, the rendered audio file is named or labeled using the hash value. Additionally, a text file, as in step 211, containing the text string (or message) is created. The text file is also named based on the hash value. In step 213, the rendered audio file and the corresponding text file are stored in the database 103.

Under the above approach, subsequent TTS requests for the same message will result in the audio file being found, and quickly supplied to the requesting application. It is recognized that there is a possibility that the audio file will be used on the first request, depending on the nature of the application and its usage of the audio content.

Figure 3:
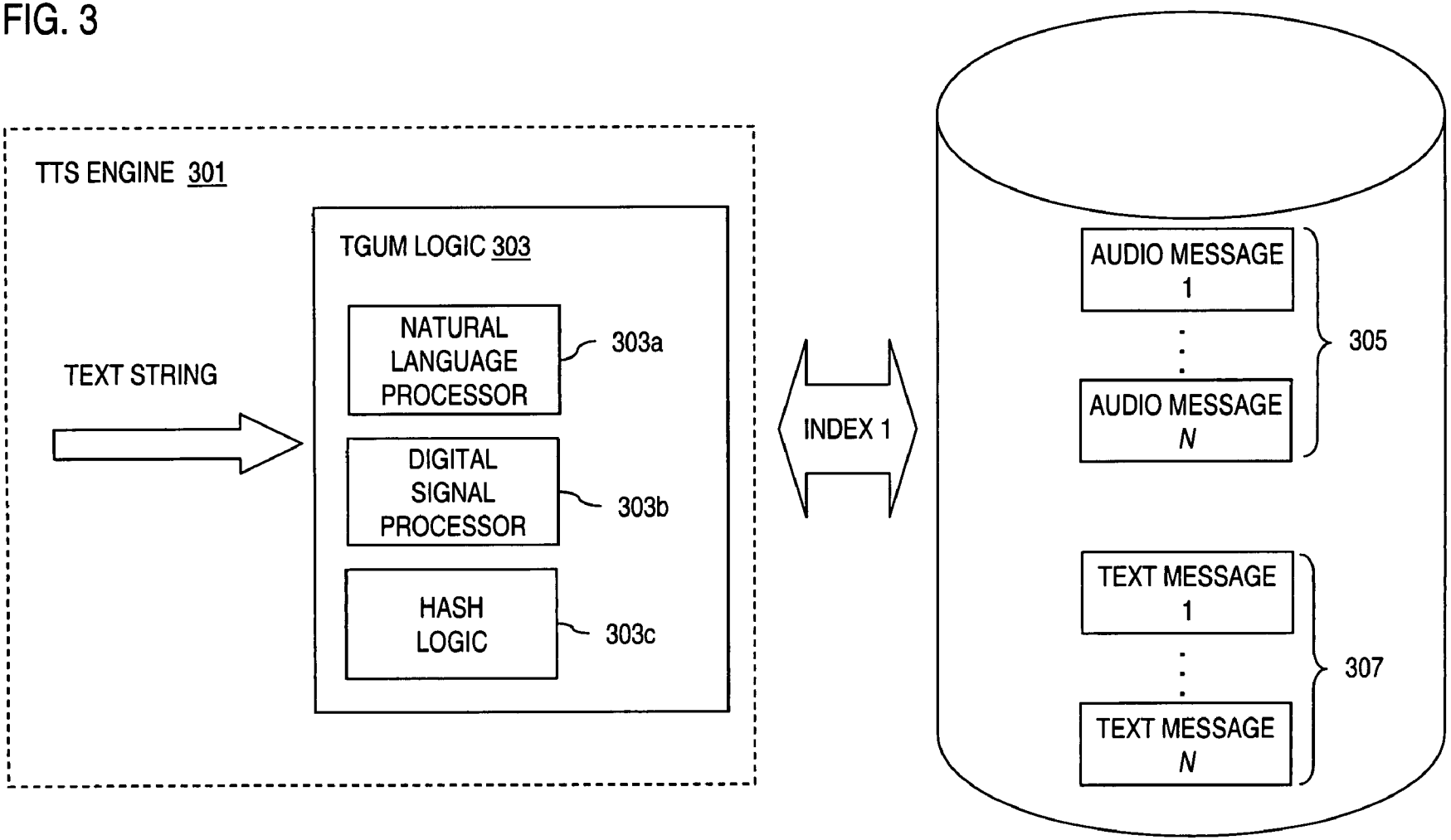
FIG. 3 is a diagram of a text-to-speech engine utilized in the system of FIG. 1.

FIG. 3 is a diagram of a text-to-speech engine utilized in the system of FIG. 1. A TTS Engine 301 employs a process for generating a unique value or index based on an input text string; one such process is a hashing algorithm. For the purposes of explanation, the TTS Engine 301 is described with respect to a hash process, which as mentioned above can be any one of the following standard algorithms: MD2, MD4, MD5, and SHA-1. Accordingly, the TTS Engine 301 includes a TTS Generation, Utilization, and Management (TGUM) logic 303 for rendering audio from the text string. The TGUM logic 303 includes standard components of a text-to-speech synthesizer, such as a Natural Language Processor 303*a* and a Digital Signal Processor (DSP) 303*b*. The Natural Language Processor 303*a* provides phonetic transcription of the text input, while the DSP 303*b* transform symbolic information to speech.

In addition the TGUM logic 303 includes hash logic 303*c* that executes a hash function to generate a hash value, e.g., Index 1, based on the input text string. In this example, it is assumed that a rendered audio file already exists within the database 103 among the audio files 305, such that Index 1 can be used to access the rendered audio message 1. It is noted that the corresponding text message 1 is also stored within the database 103 among the text message files 307.

By way of example, in pseudo code form, the TTS Engine 301 operates as follows:

String TTSmessage="Welcome to our new self-service application"String audioFileName=TGUM.create (TTSmessage);
audioFileName is "d5976f79d83d3a0dc9806c3c66f3efd8."

Figure 4:
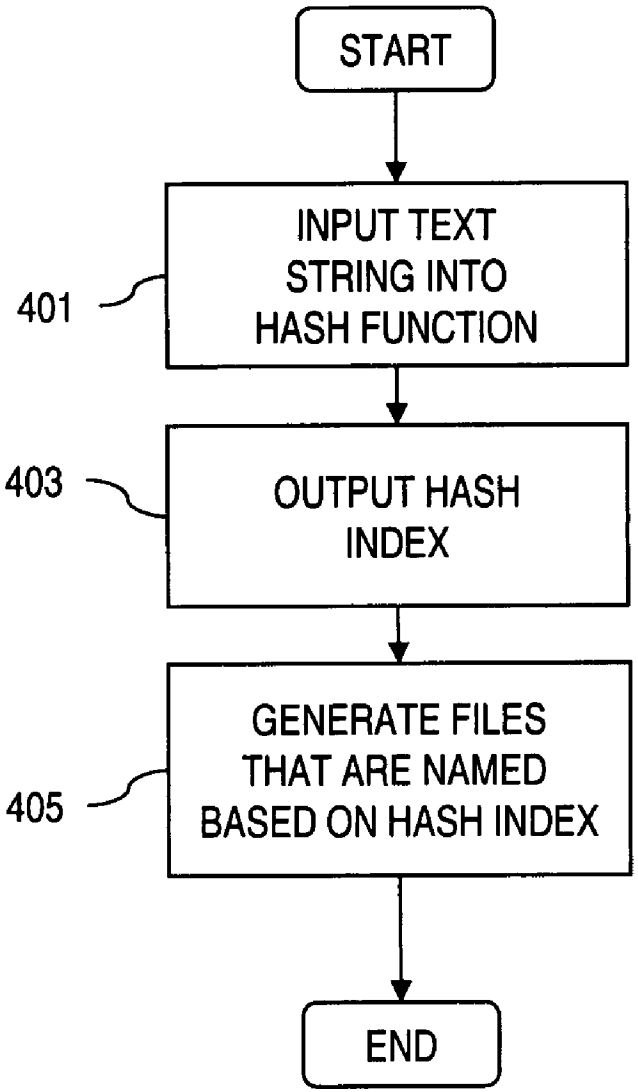
FIG. 4 is a flowchart of a hash process performed by the text-to-speech engine of FIG. 3.

The above process is also illustrated in FIG. 4, which provides a flowchart of a hash process performed by the TTS engine 301. Steps 401 and 403 involve receiving the text string message (i.e., "Welcome to our new self-service application"), whose hash value is output as "d5976f79d83d3a0dc9806c3c66f3efd8" (per step 403). Thereafter, the TGUM logic 303 creates the following two data files (for the rendered audio and the text), which are named after the hash value (step 405):

d5976f79d83d3a0dc9806c3c66f3efd8.wav<—audio content of the TTS message
d5976f79d83d3a0dc9806c3c66f3efd8.txt<—text content of the TTS message.

Depending on where, when, and how an application (e.g., resident on the host 119) needs to access the audio content, the application will either create references to the file via the web server Uniform Resource Locator (URL) or instruct some audio server (not shown) to play the audio content file.

The voice synthesis system 101 advantageously provides readily identifiable audio representation of recurring text, as to avoid costly and inefficient re-rendering of identical text. Additionally, applications that require the capability of rendering text as audio have a transparent, real-time mechanism that utilizes this underlying capability for efficient synthesized speech generation, utilization, and management.

Figure 5:
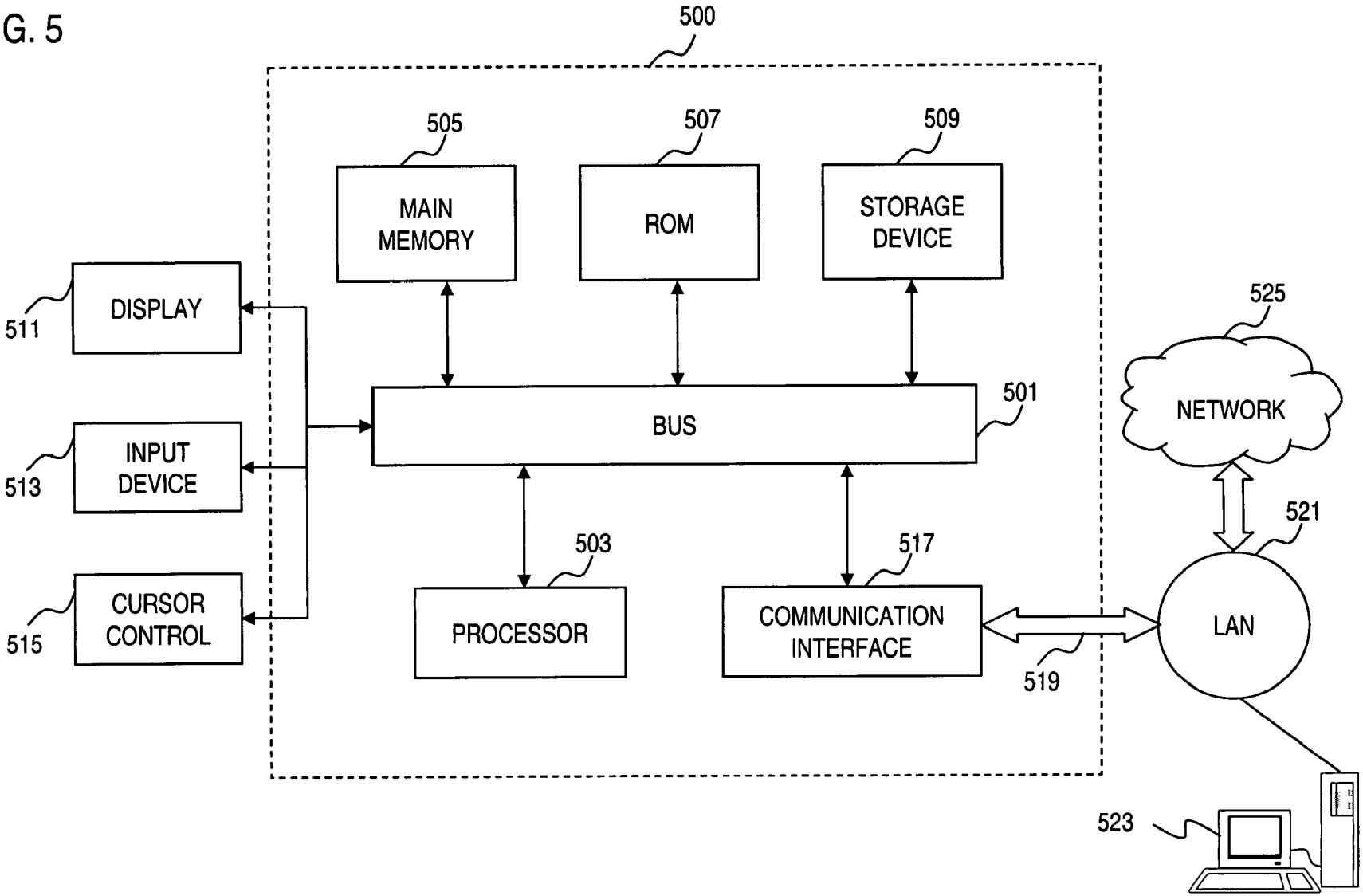
FIG. 5 is a diagram of a computer system that can be used to implement an embodiment of the present invention.

FIG. 5 illustrates a computer system 500 upon which an embodiment according to the present invention can be implemented. For example, the client and server processes for supporting fleet and asset management can be implemented using the computer system 500. The computer system 500 includes a bus 501 or other communication mechanism for communicating information and a processor 503 coupled to the bus 501 for processing information. The computer system 500 also includes main memory 505, such as a random access memory (RAM) or other dynamic storage device, coupled to the bus 501 for storing information and instructions to be executed by the processor 503. Main memory 505 can also be used for storing temporary variables or other intermediate information during execution of instructions by the processor 503. The computer system 500 may further include a read only memory (ROM) 507 or other static storage device coupled to the bus 501 for storing static information and instructions for the processor 503. A storage device 509, such as a magnetic disk or optical disk, is coupled to the bus 501 for persistently storing information and instructions.

The computer system 500 may be coupled via the bus 501 to a display 511, such as a cathode ray tube (CRT), liquid crystal display, active matrix display, or plasma display, for displaying information to a computer user. An input device 513, such as a keyboard including alphanumeric and other keys, is coupled to the bus 501 for communicating information and command selections to the processor 503. Another type of user input device is a cursor control 515, such as a mouse, a trackball, or cursor direction keys, for communicating direction information and command selections to the processor 503 and for controlling cursor movement on the display 511.

According to one embodiment of the invention, the processes of the voice synthesis system 101 and the web server 123 are performed by the computer system 500, in response to the processor 503 executing an arrangement of instructions contained in main memory 505. Such instructions can be read into main memory 505 from another computer-readable medium, such as the storage device 509. Execution of the arrangement of instructions contained in main memory 505 causes the processor 503 to perform the process steps described herein. One or more processors in a multi-processing arrangement may also be employed to execute the instructions contained in main memory 505. In alternative embodiments, hard-wired circuitry may be used in place of or in combination with software instructions to implement the embodiment of the present invention. Thus, embodiments of the present invention are not limited to any specific combination of hardware circuitry and software.

The computer system 500 also includes a communication interface 517 coupled to bus 501. The communication interface 517 provides a two-way data communication coupling to a network link 519 connected to a local network 521. For example, the communication interface 517 may be a digital subscriber line (DSL) card or modem, an integrated services digital network (ISDN) card, a cable modem, a telephone modem, or any other communication interface to provide a data communication connection to a corresponding type of communication line. As another example, communication interface 517 may be a local area network (LAN) card (e.g. for Ethernet™ or an Asynchronous Transfer Model (ATM) network) to provide a data communication connection to a compatible LAN. Wireless links can also be implemented. In any such implementation, communication interface 517 sends and receives electrical, electromagnetic, or optical signals that carry digital data streams representing various types of information. Further, the communication interface 517 can include peripheral interface devices, such as a Universal Serial Bus (USB) interface, a PCMCIA (Personal Computer Memory Card International Association) interface, etc. Although a single communication interface 517 is depicted in FIG. 5, multiple communication interfaces can also be employed.

The network link 519 typically provides data communication through one or more networks to other data devices. For example, the network link 519 may provide a connection through local network 521 to a host computer 523, which has connectivity to a network 525 (e.g. a wide area network (WAN) or the global packet data communications network now commonly referred to as the "Internet") or to data equipment operated by a service provider. The local network 521 and the network 525 both use electrical, electromagnetic, or optical signals to convey information and instructions. The signals through the various networks and the signals on the network link 519 and through the communication interface 517, which communicate digital data with the computer system 500, are exemplary forms of carrier waves bearing the information and instructions.

The computer system 500 can send messages and receive data, including program code, through the network(s), the network link 519, and the communication interface 517. In the Internet example, a server (not shown) might transmit requested code belonging to an application program for implementing an embodiment of the present invention through the network 525, the local network 521 and the communication interface 517. The processor 503 may execute the transmitted code while being received and/or store the code in the storage device 509, or other non-volatile storage for later execution. In this manner, the computer system 500 may obtain application code in the form of a carrier wave.

The term "computer-readable medium" as used herein refers to any medium that participates in providing instructions to the processor 505 for execution. Such a medium may take many forms, including but not limited to non-volatile media, volatile media, and transmission media. Non-volatile media include, for example, optical or magnetic disks, such as the storage device 509. Volatile media include dynamic memory, such as main memory 505. Transmission media include coaxial cables, copper wire and fiber optics, including the wires that comprise the bus 501. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the present invention may initially be borne on a magnetic disk of a remote computer. In such a scenario, the remote computer loads the instructions into main memory and sends the instructions over a telephone line using a modem. A modem of a local computer system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

While the present invention has been described in connection with a number of embodiments and implementations, the present invention is not so limited but covers various obvious modifications and equivalent arrangements, which fall within the purview of the appended claims.

What is claimed is:

1. A computer-implemented method for automatically providing speech synthesis, the method comprising:

receiving a text string;

determining whether a rendered audio file of the text string exists;

if the rendered audio file does not exist, creating an audio file rendering of the text string, wherein the audio file is stored for retrieval upon subsequent receipt of the text string; and generating, by a processor, a unique identifier derived from the received text string according to a hash function, wherein the stored rendered audio file is identified based on the unique identifier that includes a hash index.

2. A computer-implemented method according to claim 1, wherein the stored rendered audio file has a file name as the unique identifier.

3. A computer-implemented method according to claim 1, further comprising:

generating a text file containing the text string, wherein the text file has a file name as the unique identifier.

4. A computer-implemented method according to claim 1, wherein the text string is received from one of a voice response unit, a data network, and a circuit switched telephone network, the method further comprising:

transmitting the rendered audio file to the voice response unit.

5. A computer-implemented method according to claim 1, wherein the text string is received from a web-based application resident on a host, the method further comprising:

transmitting the rendered audio file to the host over a data network.

6. A computer-implemented method according to claim 1, the method further comprising:

generating a reference to the rendered audio file for access via a web-based interface.

7. A system for providing speech synthesis, the system comprising:

a communication interface configured to receive a text string;

a processor configured to determine whether a rendered audio file of the text string is stored in a database;

speech synthesis logic configured to render the text string to output the rendered audio file if the rendered audio is determined not to exist, wherein the rendered audio file is stored in the database for retrieval upon subsequent receipt of the text string, wherein the speech synthesis logic is further configured to generate a unique identifier derived from the received text string according to a hash function, wherein the stored rendered audio file is identified based on the unique identifier that includes a hash index.

8. A system according to claim 7, wherein the stored rendered audio file has a file name as the unique identifier.

9. A system according to claim 7, wherein the processor generates a text file containing the text string, wherein the text file has a file name as the unique identifier.

10. A system according to claim 7, wherein the text string is received from a voice response unit.

11. A system according to claim 7, wherein the text string is received from a web-based application resident on a host.

12. A system according to claim 7, the speech synthesis logic is further configured to generate a reference to the rendered audio file for access via a web-based interface.

13. A computer-readable storage medium carrying one or more sequences of one or more instructions for providing speech synthesis, the one or more sequences of one or more instructions including instructions which, when executed by one or more processors, cause the one or more processors to perform the steps of:

receiving a text string;

determining whether a rendered audio file of the text string exists;

if the rendered audio file does not exist, creating an audio file rendering of the text string, wherein the audio file is stored for retrieval upon subsequent receipt of the text string; and generating a unique identifier derived from the received text string according to a hash function, wherein the stored rendered audio file is identified based on the unique identifier that includes a hash index.

14. A computer-readable storage medium according to claim 13, wherein the stored rendered audio file has a file name as the unique identifier.

15. A computer-readable storage medium according to claim 13, further including instructions for causing the one or more processors to perform the step of:

generating a text file containing the text string, wherein the text file has a file name as the unique identifier.

16. A computer-readable storage medium according to claim 13, wherein the text string is received from one of a voice response unit, a data network, and a circuit switched telephone network, the computer-readable medium further including instructions for causing the one or more processors to perform the step of:

initiating transmission of the rendered audio file to the voice response unit.

17. A computer-readable storage medium according to claim 13, wherein the text string is received from a web-based application resident on a host, the computer-readable medium further including instructions for causing the one or more processors to perform the step of:

initiating transmission of the rendered audio file to the host over a data network.

18. A computer-readable storage medium according to claim 13, further including instructions for causing the one or more processors to perform the step of:

generating a reference to the rendered audio file for access via a web-based interface.

19. A system for providing speech synthesis in a communications network including a telephony network and a data network, the system comprising:

a speech synthesis node configured to receive a text string from one of the telephony network and the data network, the speech synthesis node being further configured to determine whether a rendered audio file of the text string is stored in a database and to convert the text string to an audio file for rendering if the rendered audio is determined not to exist, wherein a unique identifier is generated based on the received text string according to a hash function, and the stored rendered audio file is identified based on the unique identifier that includes a hash index.

20. A system according to claim 19, further comprising:

a server configured to provide access via a web-based interface to the stored rendered audio file.

21. A system according to claim 19, further comprising:

a voice response unit in communication with the telephony network and configured to generate the text string.

* * * * *